US006779856B2

(12) United States Patent
Hornberger et al.

(10) Patent No.: US 6,779,856 B2
(45) Date of Patent: Aug. 24, 2004

(54) COUNTERBALANCED DOOR SYSTEM FOR A STORAGE CABINET

(75) Inventors: Timothy G. Hornberger, Green Bay, WI (US); Karl J. Koehler, Brillion, WI (US); Dennis G. Griepentrog, De Pere, WI (US)

(73) Assignee: Krueger International, Inc., Green Bay, WI (US)

( * ) Notice: Subject to any disclaimer, the term of this patent is extended or adjusted under 35 U.S.C. 154(b) by 0 days.

(21) Appl. No.: 10/080,003

(22) Filed: Feb. 21, 2002

(65) Prior Publication Data

US 2002/0113532 A1 Aug. 22, 2002

Related U.S. Application Data

(60) Provisional application No. 60/270,573, filed on Feb. 22, 2001.

(51) Int. Cl.[7] ..... A47B 88/00

(52) U.S. Cl. ..... 312/295; 312/319.2; 312/323; 312/325

(58) Field of Search ..... 312/319.1, 322, 312/323, 326, 327, 378, 319.2, 315, 245, 295, 271, 324, 325; 49/40, 203, 204, 205, 114, 109, 110

(56) References Cited

U.S. PATENT DOCUMENTS

| | | | | |
|---|---|---|---|---|
| 287,068 A | | 10/1883 | Tyler | |
| 463,150 A | | 11/1891 | Graves | |
| 544,773 A | * | 8/1895 | Schill | 126/191 |
| 553,073 A | | 1/1896 | Potteiger et al. | |
| 654,501 A | | 7/1900 | Wilson | |
| 658,310 A | | 9/1900 | Babb | |
| 1,115,345 A | | 10/1914 | Steuernagel | |
| 1,331,143 A | | 2/1920 | Chriskos | |
| 1,451,207 A | | 4/1923 | Draper | |
| 1,800,519 A | | 4/1931 | Fredberg | |
| 1,817,921 A | * | 8/1931 | Knaggs | 49/109 |
| 1,842,708 A | * | 1/1932 | Barnes | 126/191 |
| 1,941,541 A | | 1/1934 | Dibble | |
| 1,964,578 A | | 6/1934 | Hunter | |
| 2,089,709 A | | 8/1937 | Rabkin | |
| 2,100,795 A | * | 11/1937 | Baumgarten | 49/110 |
| 2,187,320 A | | 1/1940 | Hoffstetter et al. | |
| 2,296,956 A | | 9/1942 | Sickinger | |
| 2,301,856 A | | 11/1942 | Conwell | |
| 2,551,305 A | | 5/1951 | Tompkins | |
| 2,590,028 A | | 3/1952 | Miller | |
| 2,598,814 A | * | 6/1952 | McAfee | 312/275 |

(List continued on next page.)

FOREIGN PATENT DOCUMENTS

| | | | | |
|---|---|---|---|---|
| DE | 4013571 | | 10/1991 | |
| DE | 4013571 A | * | 10/1991 | A47L/15/42 |
| FR | 2091715 | | 1/1972 | |
| FR | 2723071 | | 2/1996 | |

*Primary Examiner*—Lanna Mai
(74) *Attorney, Agent, or Firm*—Boyle, Fredrickson, Newholm, Stein & Gratz, S.C.

(57) ABSTRACT

A storage unit includes a cabinet defining an interior and a door assembly, which has a first door section and a second door section. Each of the door sections is pivotably mounted to the cabinet for movement between an open position and a closed position. The first and second door sections prevent access to the interior of the cabinet when in the closed position and provide access to the interior of the cabinet when in the oven position. The storage unit also includes a link pivotably interconnected between the first and second door sections so as to synchronize movement of the first and second door sections between the open and closed positions. A biasing arrangement counterbalances the door assembly and maintains the first and second door sections in both the open position and closed position and positions therebetween.

14 Claims, 8 Drawing Sheets

U.S. PATENT DOCUMENTS

| | | | | | |
|---|---|---|---|---|---|
| 2,617,702 | A | | 11/1952 | Manning et al. | |
| 2,853,352 | A | | 9/1958 | Gittins | |
| 2,869,954 | A | | 1/1959 | Kesling | |
| 2,997,041 | A | * | 8/1961 | Wolske | 126/191 |
| 3,049,390 | A | | 8/1962 | Wolfe | |
| 3,128,508 | A | | 4/1964 | Burnham | |
| 3,184,277 | A | | 5/1965 | Stevens | |
| 3,279,874 | A | | 10/1966 | Noren et al. | |
| 3,539,239 | A | | 11/1970 | Mallonn | |
| 4,024,671 | A | * | 5/1977 | Isobe | 49/104 |
| 4,167,298 | A | | 9/1979 | Plattner | |
| 4,383,721 | A | | 5/1983 | Knaack et al. | |
| 4,429,933 | A | | 2/1984 | Sokolowski | |
| 4,706,333 | A | | 11/1987 | Lauderbach | |
| 4,798,425 | A | | 1/1989 | Armstrong et al. | |
| 4,856,854 | A | | 8/1989 | Nishiyama et al. | |
| 4,964,683 | A | | 10/1990 | Sugarek et al. | |
| 5,050,943 | A | | 9/1991 | Barnett | |
| 5,172,969 | A | | 12/1992 | Reuter et al. | |
| 5,257,638 | A | | 11/1993 | Alvemarker | |
| 5,341,542 | A | | 8/1994 | Hannan et al. | |
| 5,409,308 | A | | 4/1995 | Reuter et al. | |
| 5,522,656 | A | | 6/1996 | Jenkins | |
| 5,553,724 | A | | 9/1996 | Moher et al. | |
| 5,593,203 | A | | 1/1997 | Abbott | |
| 5,622,414 | A | | 4/1997 | Artwohl et al. | |
| 5,645,333 | A | | 7/1997 | Sakurai | |
| 5,758,937 | A | | 6/1998 | Lammens et al. | |
| D400,383 | S | | 11/1998 | Fricano et al. | |
| 5,845,980 | A | | 12/1998 | Fricano et al. | |
| 5,882,099 | A | | 3/1999 | Salice | |
| 5,904,411 | A | | 5/1999 | Hayakawa | |
| D410,351 | S | | 6/1999 | Magnusson et al. | |
| 5,971,514 | A | | 10/1999 | Hayakawa | |
| 6,007,171 | A | | 12/1999 | Varellas-Olree | |

* cited by examiner

FIG. 3
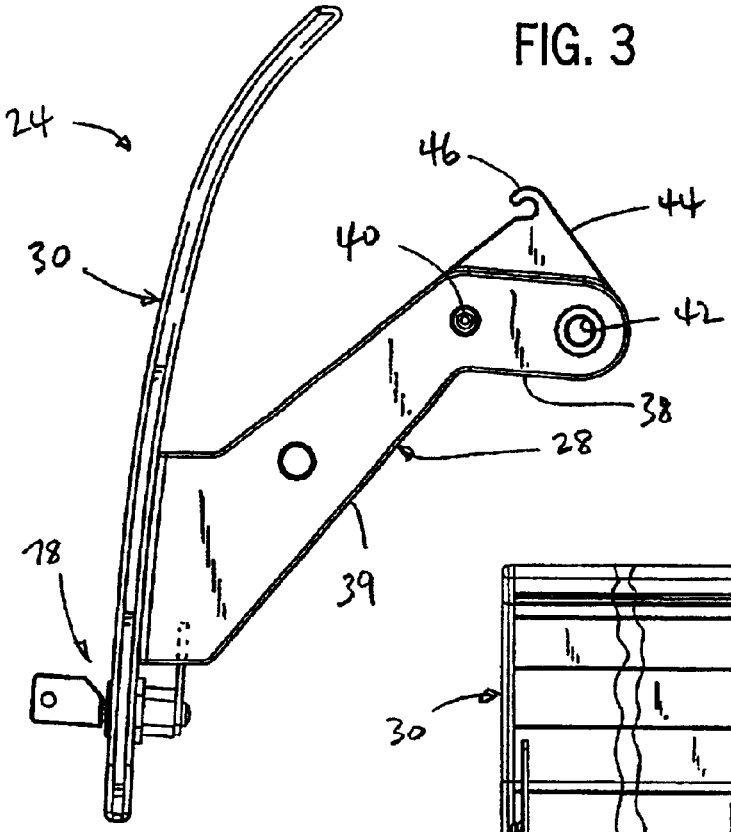
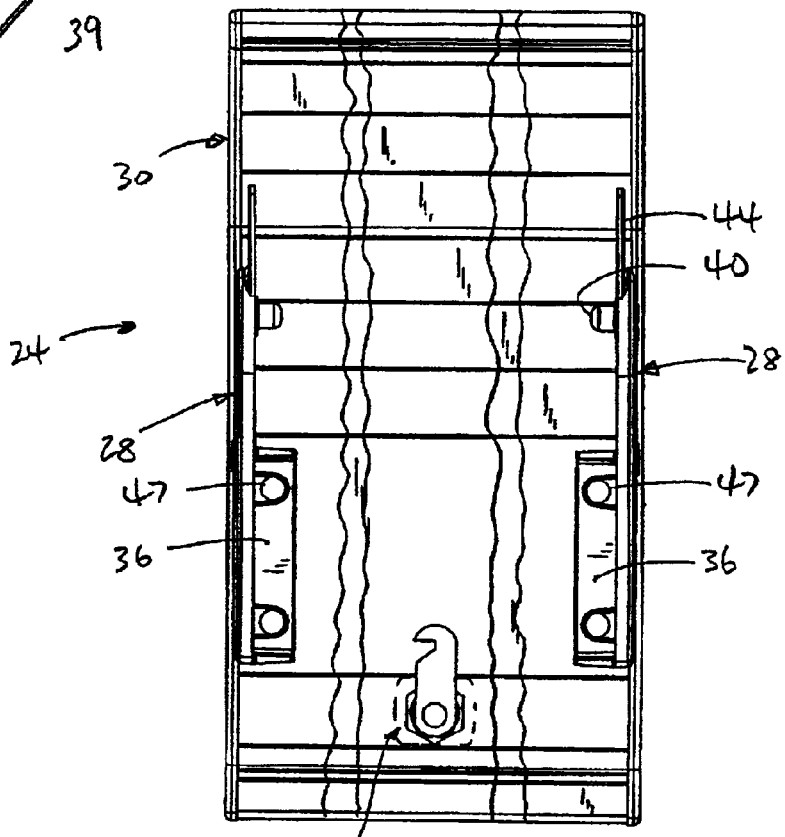
FIG. 4

COUNTERBALANCED DOOR SYSTEM FOR A STORAGE CABINET

CROSS-REFERENCE TO RELATED APPLICATIONS

This application claims the benefit of U.S. Provisional Application Serial No. 60/270,573, filed Feb. 22, 2001.

BACKGROUND AND SUMMARY OF THE INVENTION

This invention relates to a storage unit, and more particularly to a counterbalancing arrangement for a door associated with an overhead-type storage unit.

An overhead storage unit typically includes a cabinet defining an interior and having an open front which provides access to the cabinet interior. A door is typically interconnected with the cabinet, and is movable between an open position in which the door allows access to the interior of the cabinet through the open front, and a closed position in which the door closes the open front of the cabinet to prevent access to the cabinet interior. Various types of doors are known, including flipper-type doors and doors which are mounted to the cabinet via an arm arrangement which provides pivoting movement of the door relative to the cabinet.

It is an object of the present invention to provide an overhead storage unit having a cabinet and a door arrangement in which a door is pivotably mounted to the cabinet for movement between open and closed positions, and which includes a counterbalancing arrangement that counterbalances the weight of the door to provide ease of movement of the door between its open and closed positions. It is a further object of the invention to provide an overhead storage unit having a counterbalanced clamshell-type door construction which includes a pair of door sections that are movable together and apart between their closed and open positions. It is a further object of the invention to provide an overhead storage unit having a clamshell-type door arrangement in which the door sections are synchronously moved between their open and closed positions, and in which the weight of the door components is counterbalanced so as to provide ease of movement of the door sections between their open and closed positions. Yet another object of the invention is to provide a counterbalanced door arrangement which can easily be incorporated into a cabinet without impinging on the interior storage space of the cabinet and which does not detract from the overall aesthetic external appearance of the storage unit. Yet another object of the invention is to provide an overhead storage unit with such a counterbalanced door arrangement which is relatively simple in its components and construction, and which can be easily incorporated into the assembly of the overhead storage unit.

In accordance with the invention, a storage unit, such as an overhead storage unit, includes a cabinet defining an interior and having an open front which provides access to the cabinet interior. The storage unit includes a door arrangement interconnected with the cabinet, which is movable relative to the cabinet between an open position in which the interior of the cabinet can be accessed through the open front of the cabinet, and a closed position in which the door arrangement closes the open front of the cabinet for preventing access to the cabinet interior. The door arrangement is counterbalanced so as to be biased toward its open position, to provide an assist to the user when the door arrangement is moved from its closed position to its open position, and for maintaining the door arrangement in its open position when so positioned by the user. In addition, the door arrangement is preferably of a clamshell-type construction, having a first door section and a second door section which are moved toward each other when the door arrangement is in its closed position, and moved apart from each other when the door arrangement is in its open position.

In one form, the first door section includes an upper door member extending between a pair of upper arms, each of which is pivotably mounted to the cabinet for providing movement of the upper door member between its open and closed positions. Similarly, the second door section may be in the form of a lower door member mounted between a pair of lower arms which are pivotably interconnected with the cabinet, for providing movement of the lower door member between its open and closed positions. Counterbalancing of the door arrangement is accomplished by interconnecting a biasing arrangement with one of the sets of arms, e.g. the upper arms, which tends to rotatably bias the arms upwardly so as to counterbalance the weight of the upper door member. In one form, the biasing arrangement is in the form of a spring connected between the cabinet and at least one of the upper arms. The spring and the upper arm are configured and arranged such that the spring applies a force to the upper arm which tends to rotate the upper arm about its pivot axis, to urge the upper arm upwardly. In another form, the biasing arrangement is in the form of a counterbalancing weight connected to the upper arm at a location rearwardly of its pivot axis, to bias the upper arm upwardly.

The upper and lower door sections are connected together so as to be synchronously movable between their open and closed positions. To accomplish this, a link member is interconnected between at least one of the sets of upper and lower arms. The link member is pivotably mounted to the upper arm at a location forwardly of the upper arm pivot axis, and is pivotably connected to the lower arm at a location rearwardly of the lower arm pivot axis. In this manner, the link member functions to raise the lower arm as the upper arm is lowered, to move the lower door section toward the upper door section and to bring the upper and lower door sections together when one of the door sections is moved toward its closed position. Likewise, the link member functions to lower the lower arm as the upper arm is raised, to move the upper and lower door sections apart when one of the door sections is moved toward its open position.

The weight of the components of the upper door section, located forwardly of the upper arm pivot axis, is operable to overcome the biasing force of the counterbalancing arrangement, to maintain the upper door section in position against the force of the biasing arrangement. In addition, the weight of the forward components of the upper door section is also sufficient to maintain the lower door section in position, by virtue of the link member which tends to raise the lower door section when the upper door section is closed. When the user moves either the upper door section or the lower door section away from its closed position toward its open position, the counterbalancing arrangement is operable to assist the user in opening the door sections, and the force of the counterbalancing arrangement maintains the door sections in any position when the user releases the door sections. When the door sections are in their open positions, the counterbalancing arrangement functions to maintain the door sections in the open position until the door sections are once again moved toward their closed positions against the force of the counterbalancing arrangement.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings:

FIG. 3 is a side elevation view of the upper door section forming a part of the door system incorporated into the overhead storage unit of FIG. 1;

FIG. 4 is a rear elevation view, with portions broken away, showing the upper door section of FIG. 3;

DETAILED DESCRIPTION OF THE INVENTION

Figure 1:
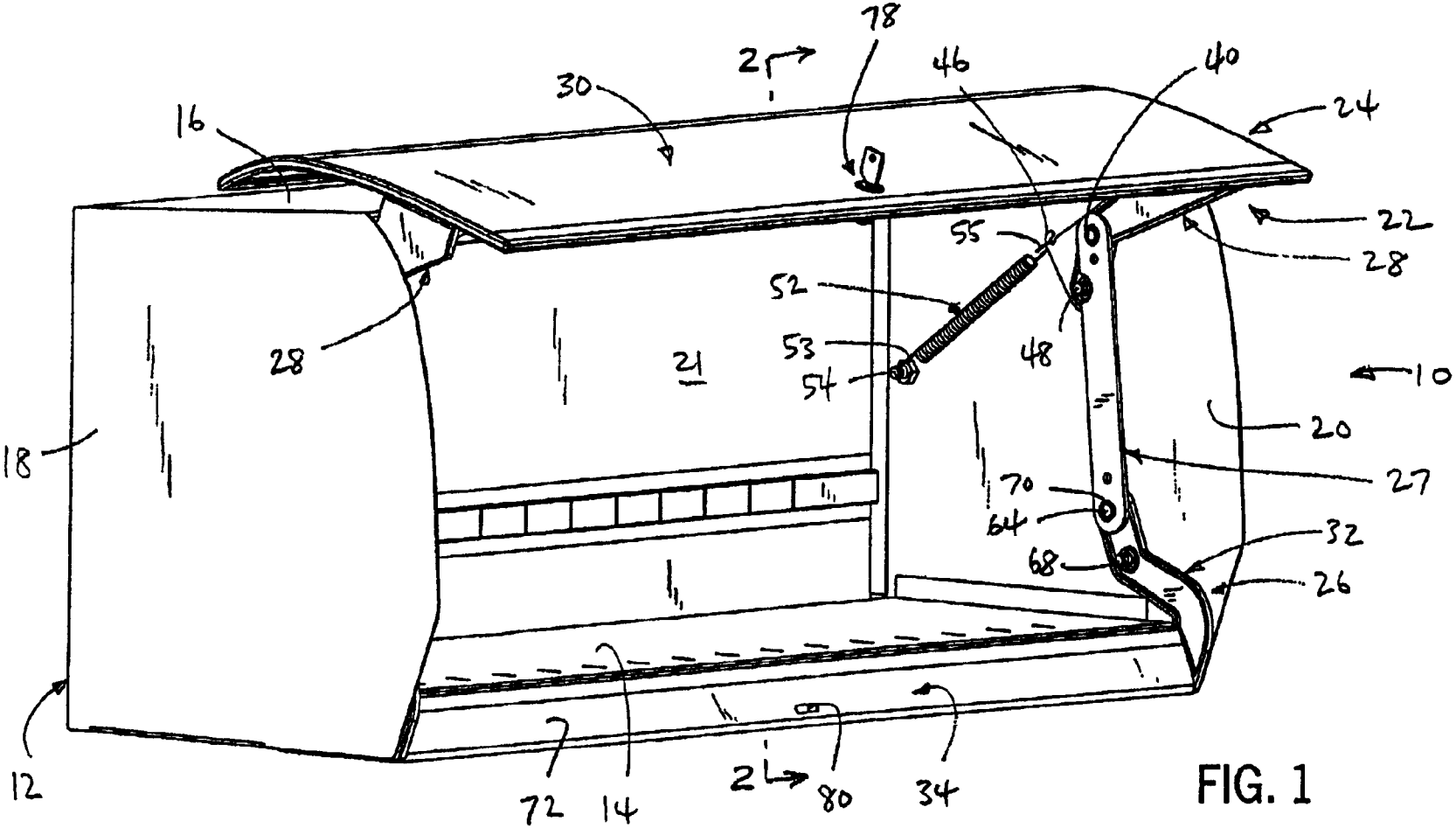
FIG. 1 is an isometric view of an overhead storage unit incorporating the counterbalanced door system of the present invention, showing the upper and lower door sections in an open position.
Figure 2:
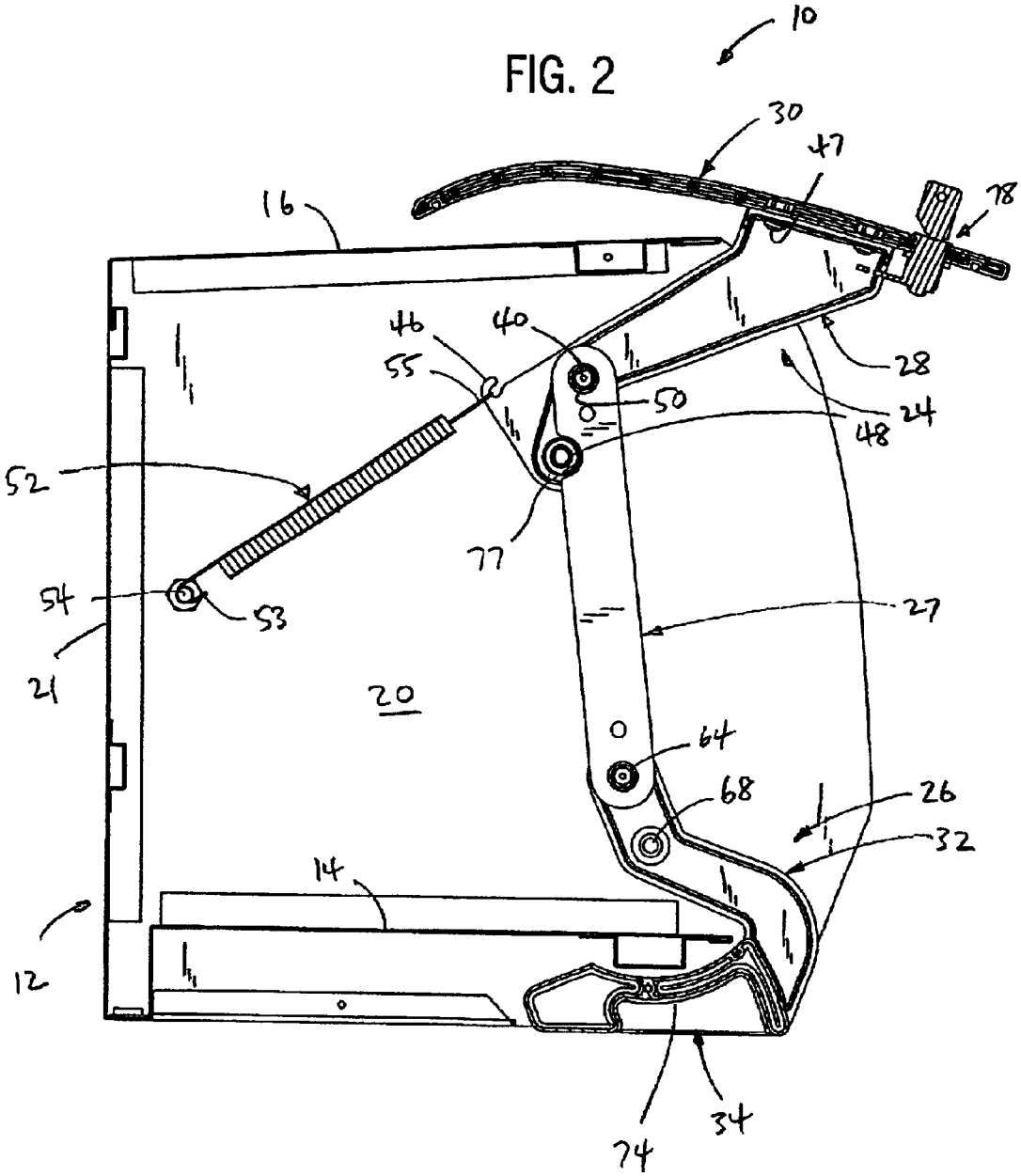
FIG. 2 is a section view taken along line 2—2 of FIG. 1, again showing the door sections in the open position.
Figure 2A:
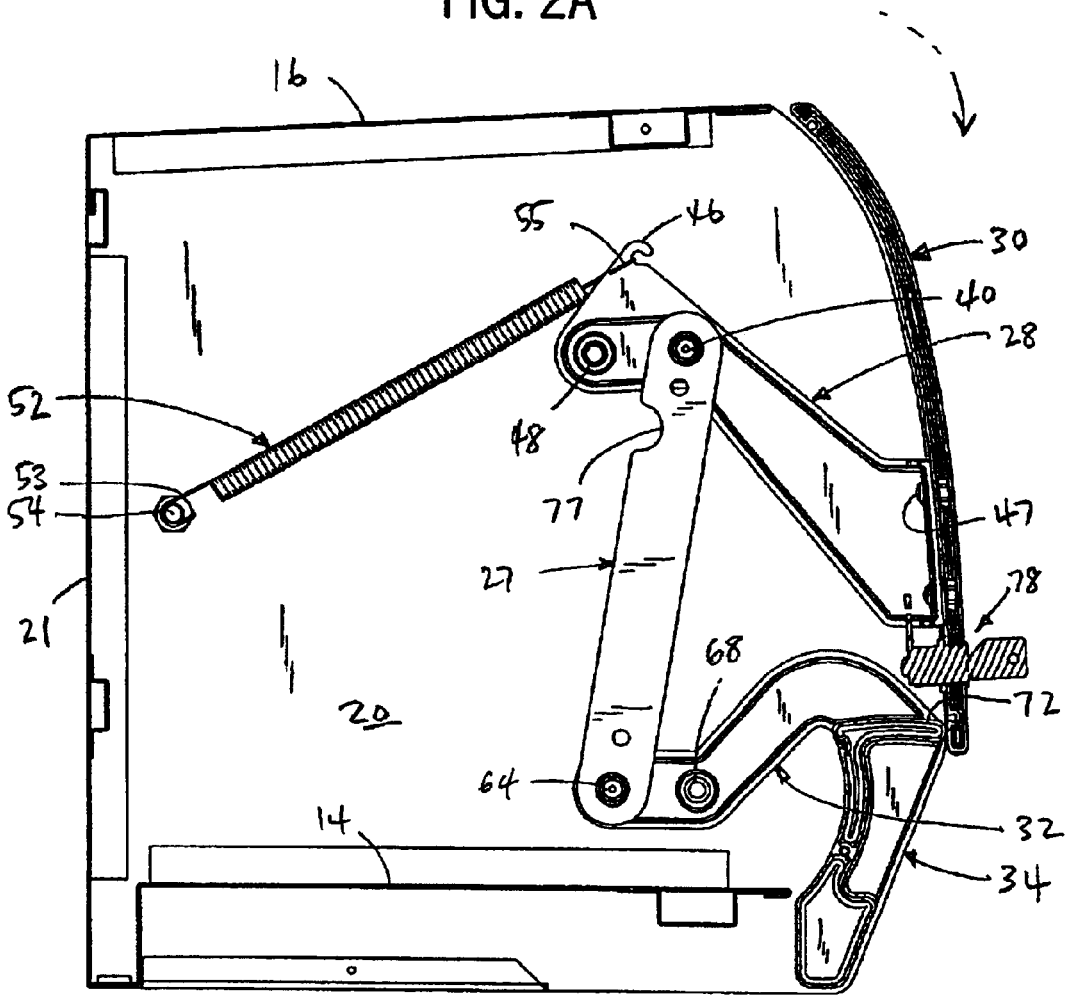
FIG. 2A is a view similar to FIG. 2, showing the door sections in the closed position.
Figure 6:
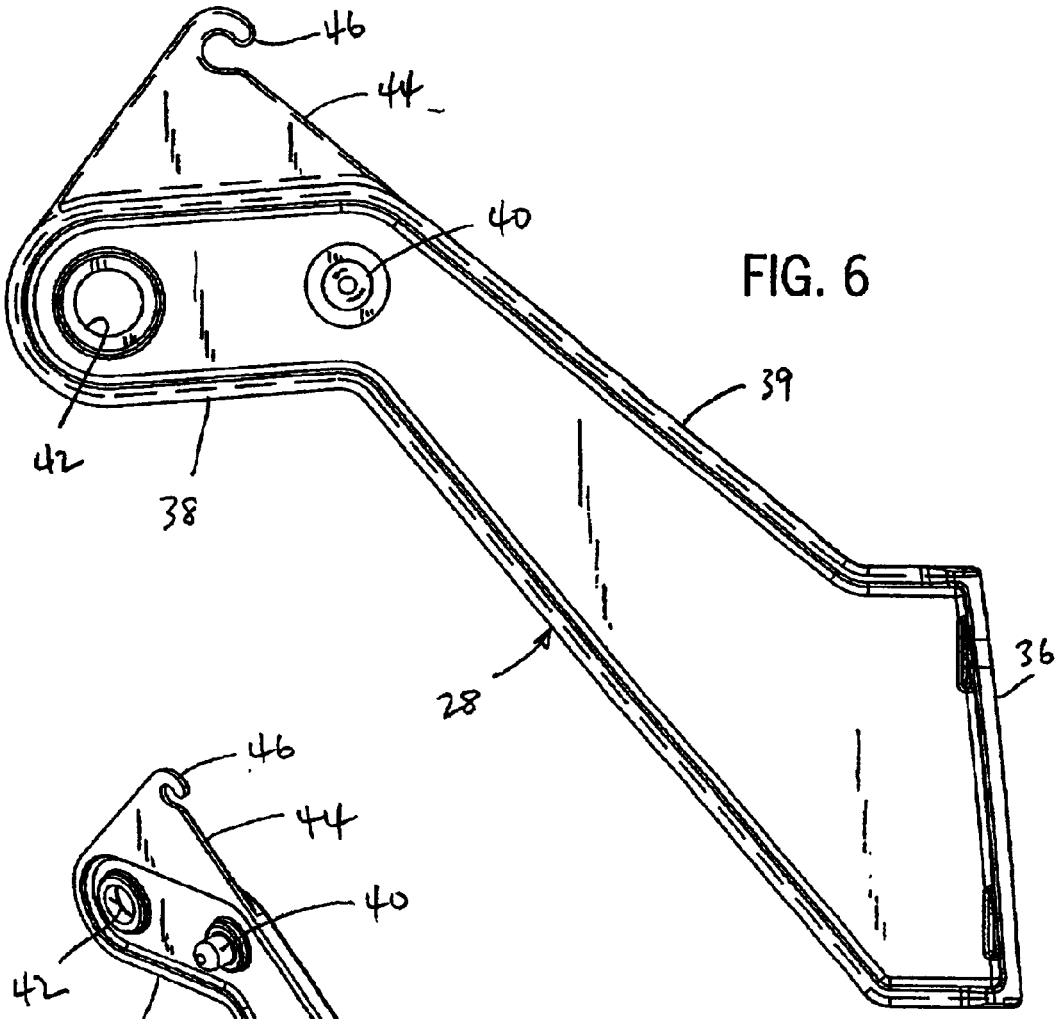
FIG. 6 is an elevation view of the upper arm of FIG. 5.

Referring to FIGS. 1, 2 and 2A, an overhead storage unit 10 includes a cabinet assembly or case 12 formed of a bottom wall 14, a top wall 16, a pair of end walls 18, 20, and a back wall 21, all of which cooperate to define an outwardly open interior in a manner as is known. A door assembly 22, constructed in accordance with the present invention, is movably secured to case 12 for selectively providing and preventing access to the interior of case 12.

Door assembly 22 includes an upper door section or subassembly 24 and a lower door section or subassembly 26, which are interconnected with each other via a link 27. Door assembly 22 is of a clamshell-type construction, such that upper door subassembly 24 and lower door subassembly 26 are selectively moved together and apart from each other between closed and open positions. FIGS. 1 and 2 illustrate upper door subassembly 24 and lower door subassembly 26 in the open position, so as to provide access to the interior of case 12. FIG. 2A illustrates upper door subassembly 24 and lower door subassembly 26 in the closed position, so as to prevent access to the interior of case 12.

Upper door subassembly 24 includes a pair of upper arms 28 and an upper door member 30 connected between arms 28. Similarly, lower door subassembly 26 includes a pair of lower arms 32 and a lower door member 34 extending between lower arms 32.

Figure 5:
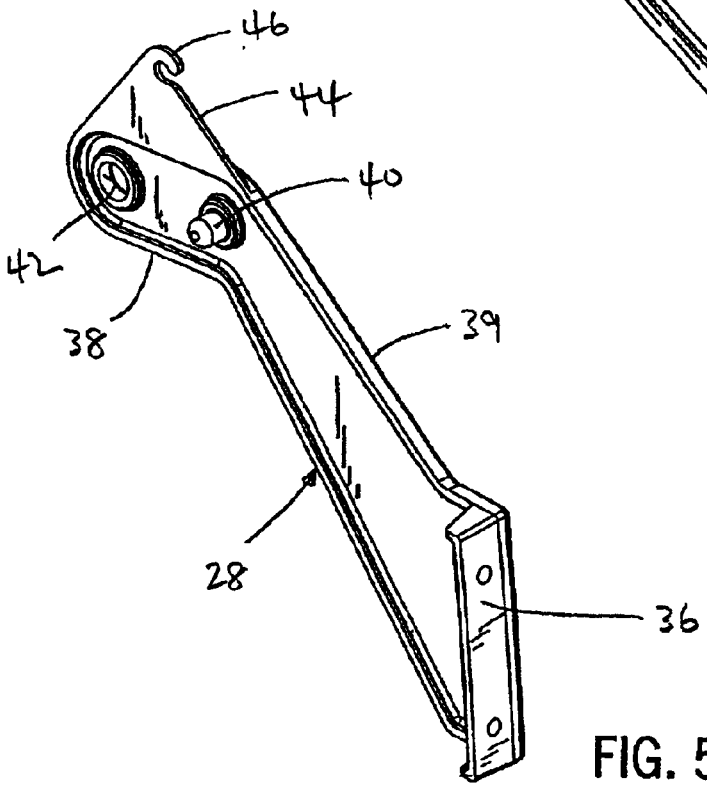
FIG. 5 is an isometric view of an upper arm incorporated into the upper door section of FIG. 3.
Figure 7:
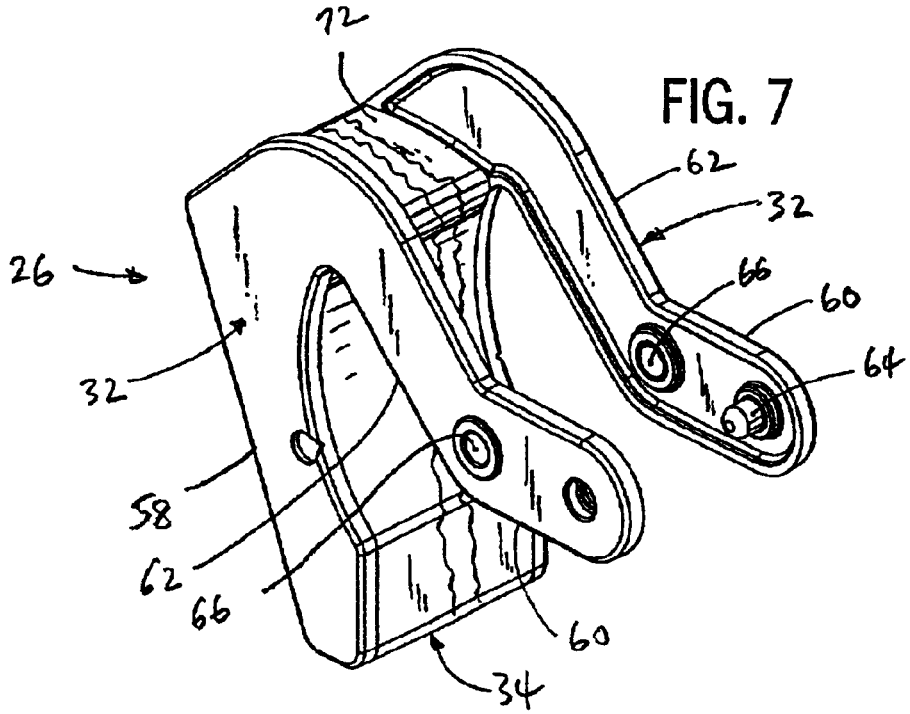
FIG. 7 is an isometric view of the lower door section, with portions broken away, forming a part of the door system incorporated into the overhead storage unit of FIG. 1.
Figure 8:
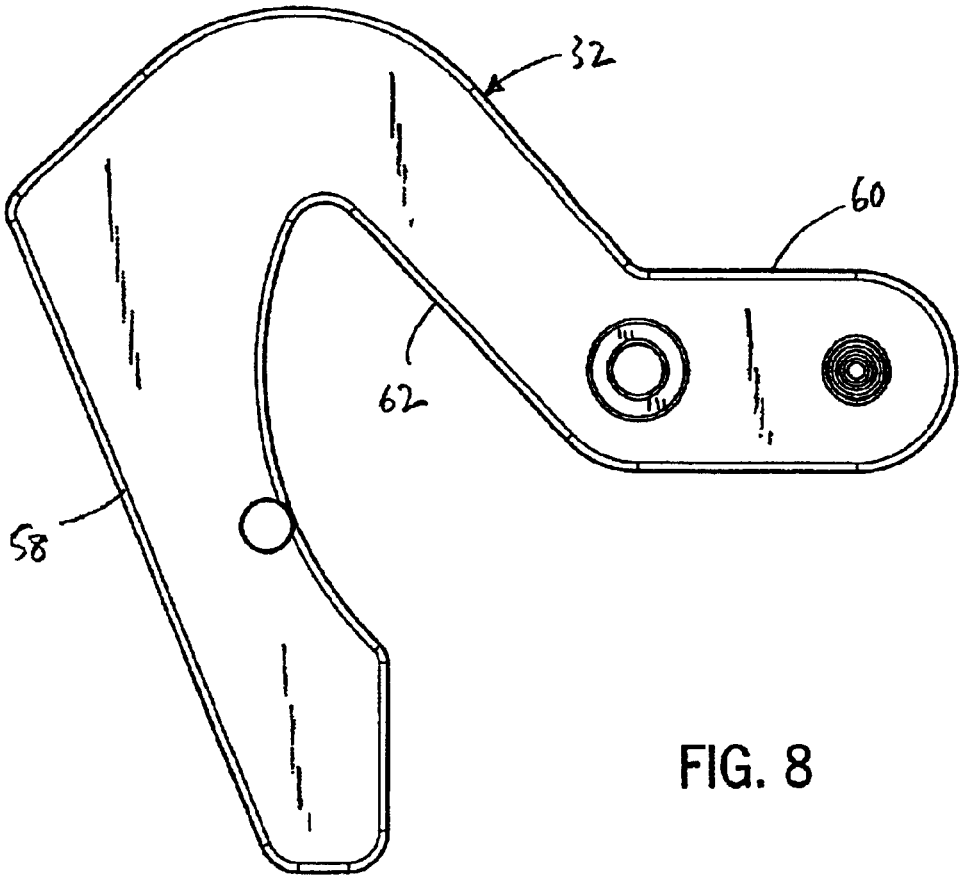
FIG. 8 is an outer elevation view of one of the lower arms incorporated into the lower door section of FIG. 7.

As shown in FIGS. 3–5, each upper arm 28 includes an outer door mounting bracket section 36 and an inner arm section 38, which are interconnected by an intermediate arm section 39. A pivot stud 40 is mounted at the forward end of inner section 38, extending inwardly therefrom. An opening 42 is formed at the end of inner section 38, and an ear 44 extends upwardly from inner section 38. The upper end of ear 44 terminates in a hook 46.

The ends of upper door member 30 are mounted to and between outer door mounting bracket sections 36 of upper arms 28. Representatively, fasteners such as screws 47 may extend through openings in outer door mounting bracket section 36 and into engagement with threaded anchors or openings associated with the underlying area of door 30, to mount door 30 to and between arms 28.

As shown in FIGS. 1, 2 and 2A, each arm 28 is pivotably mounted to one of case end walls 18, 20 via a pin 48 which extends through opening 42, such that upper arms 28 are pivotable about a pivot axis defined by the aligned longitudinal axes of pins 48. The upper end of each link 27 is pivotably mounted to a corresponding one of upper arms 28 through engagement of stud 40 within an opening 50 formed in the upper end of link 27. A conventional retainer is engaged with stud 40 for retaining link 27 in position on stud 40.

A spring 52 is engaged with each upper arm 28. As shown in FIGS. 1, 2 and 2A, the rear end of spring 52 includes a hook 53 which is fixed to case end wall 20 by engagement with a retainer pin 54 extending inwardly from case end wall 20. The opposite, front end of spring 52 includes a hook 55 which is engaged with hook 46 at the upper end of ear 44 associated with inner arm section 38. A similar spring 52 is engaged with upper arm 28 which is pivotably mounted to case end wall 18. Springs 52 function to counterbalance the weight of upper door subassembly 24, about the upper door section pivot axis defined by the upper arm pivot pins 48. Referring to FIG. 2, springs 52 function to counterbalance upper door subassembly 24 in a counterclockwise direction about pivot pins 48.

As shown in FIGS. 7–10, each lower arm 32 defines an outer door mounting section 58, and lower door member 34 extends between door mounting sections 58. Each lower arm 32 further includes an inner section 60 extending inwardly from the inner end of an intermediate section 62 which extends between each door mounting section 58 and inner section 60. An inwardly extending pivot stud 64 is mounted toward the end of each inner section 60, and an opening 66 is formed in each lower arm 32 at the intersection of intermediate section 62 and inner section 60.

Referring to FIG. 1, a pivot pin 68 extends through each opening 66 so as to pivotably mount lower arms 32 to and between case end walls 18, 20 for movement about a pivot axis defined by the aligned longitudinal axes of pins 68. The lower end of each link 27 is pivotably mounted to one of lower arms 32 via engagement of stud 64 within an opening 70 formed in a link 27. Again, a conventional retainer is engaged with stud 64 for retaining link 27 in position on stud 64.

The shape of lower arm door mounting section 58 corresponds to the general shape of the cross section of lower door member 34. In the illustrated embodiment, lower door member 34 is in the form of an extrusion member formed of any satisfactory material such as rigid thermoplastic or aluminum, defining a closed shape. Lower door member 34 includes an angled surface 72 which extends downwardly and forwardly relative to bottom wall 14 when lower door assembly 26 is in its open position as shown in FIG. 1, and which is located closely adjacent or in engagement with the lower end of upper door member 30 when lower door assembly 26 is in its closed position. Lower door member 34 further includes a recess 74 (FIG. 2) along its length, which provides a hand grip area for facilitating manual engagement with lower door member 34.

Figure 10:
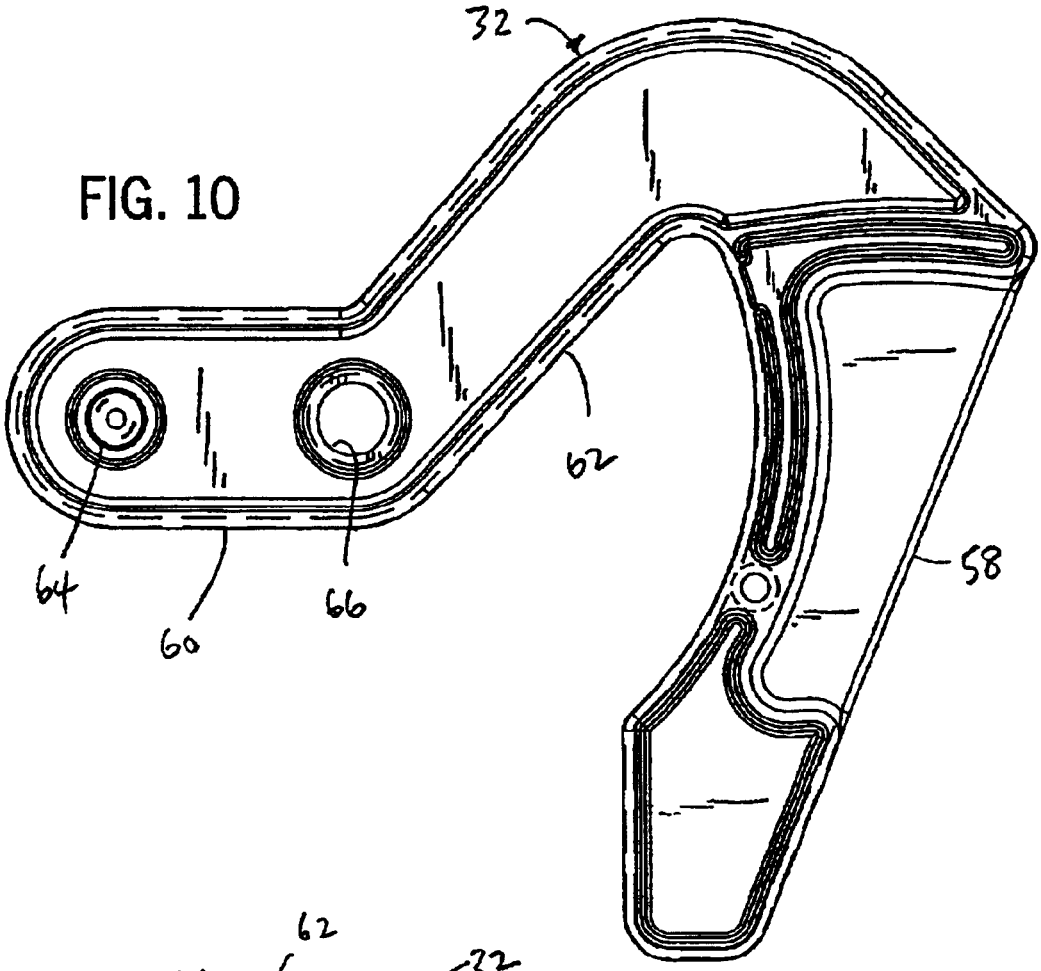
FIG. 10 is an inner elevation view of the lower arm of FIG. 9.
Figure 9:
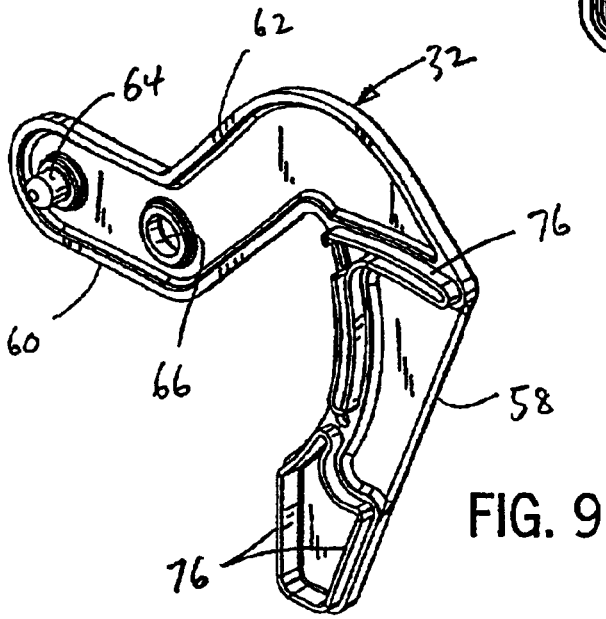
FIG. 9 is an isometric view of the inner area of one of the lower arms of FIG. 8.

Referring to FIGS. 9 and 10, door mounting section 58 of each lower arm 32 includes a series of ridges 76 which correspond to the shape of an internal passage defined by lower door member 34. Ridges 76 facilitate engagement of each lower arm 26 with lower door member 34, which are secured together in any satisfactory manner such as by means of a structural adhesive, welding or the like. Lower arms 32 may be formed of a rigid thermoplastic material such as polycarbonate in an injection molding process, although any other satisfactory material and forming method may be employed.

In operation, upper door subassembly 24 and lower door subassembly 26 function as follows to selectively provide and prevent access to the interior of case 12.

With door assembly 22 in its open position as shown in FIGS. 1 and 2, springs 52 provide rearward biasing forces on upper arms 28 tending to pivot upper arms 28 in a counterclockwise direction about pivot pins 48. The bias of springs 52 maintains counterbalances the weight of the components of door assembly 22, due to the application of a downward and rearward force on each upper arm 28 at a location offset vertically above pivot pin 48. The force of each spring 52 is selected so as to ensure that springs 52 are capable of maintaining both upper door subassembly 24 and lower door subassembly 26 in any desired position when released by the user. With upper door subassembly 24 in its open position, link 27 is positioned so as to place lower door subassembly 26 in its open position as shown in FIGS. 1 and 2. Link 27 includes a notch 77 which receives pivot pin 48 when door assembly 22 is in its open position.

When it is desired to close door assembly 22, the user manually engages either upper door member 30 or lower door member 34, typically by manually engaging recess 74 in lower door member 34 or the forward end of upper door member 30. The user then exerts a downward force on upper door member 30 or an upward force on lower door member 34. This causes upper arms 28 to pivot about pins 48 in a clockwise direction or lower arms 32 to pivot in a counterclockwise direction, with reference to FIG. 2, against the biasing force exerted by springs 52.

As upper door subassembly 24 and lower door subassembly 26 are moved in this manner, link 27 is simultaneously moved in a downward direction through engagement with studs 40, 64. This downward movement of link 27 exerts a downward force on either the inner end 60 of lower arm 32 or on upper arm 28 at the location of stud 40. As shown in FIGS. 1 and 2, when door assembly 22 is in its open position, stud 40 of upper arm 28 is located above and forwardly of pivot pin 48, and stud 64 of lower arm 32 is located above and rearwardly of pivot pin 68. When lower door member 34 is being lifted so as to close door assembly 22, the downward force exerted by link 27 functions to pivot upper arm 28 about pivot pin 48, to move upper door subassembly 24 toward its closed position against the force of spring 52. The user continues such upward movement of lower door subassembly 26 and the resultant downward movement of upper door subassembly 24 until upper door member 30 and lower door member 34 are moved together in a closed position, as shown in FIG. 2A. In a similar manner, application of a downward force on upper door member 30 causes clockwise pivoting movement of upper arm 28 about pivot pin 48, which exerts a downward force on link 27 through engagement of link 27 with stud 40. This downward force on link 27 is applied to lower arm 32 at stud 64, which causes simultaneous counterclockwise pivoting movement of lower arm 32 about pivot pin 68 to move lower door member 34 upwardly. Downward movement of upper door member 30 continues until upper door member 30 and lower door member 34 are moved together to a closed position. A lock, shown generally at 78, is mounted to upper door member 30 toward its lower end so as to engage a slot 80 formed in surface 72 of lower door member 34, to lock door assembly 22 in its closed position.

The majority of the weight of upper door subassembly 24 is located outwardly of pivot pins 48 when upper door subassembly 24 is closed, and the moment at pivot pins 48 when upper door assembly 24 is closed is sufficient to overcome the biasing forces of springs 52 and lower door subassembly 26, to maintain door assembly 22 in its closed position. When it is once again desired to open door assembly 22, the user exerts an upward force on upper door assembly 24, or a downward force on lower door subassembly 26, and springs 52 counterbalance the weight of upper door subassembly 24 to easy movement of door assembly 22 toward its open position. When door assembly is in its open position, detents associated with cabinet end walls 18, 20 and upper arms 28 provide a stop for maintaining door assembly 22 open, and a user-perceptible feel that the open position has been reached.

Movement of door assembly 22 from its closed position toward its open position causes a reduction in the moment at pivot pins 48. The force of spring 52 is selected such that the force of spring 52 progressively decreases in proportion to reduction of the moment at pivot pins 48, to enable the components of door assembly 22 to remain at any angular position when released by the user. When door assembly 22 is moved from its open position to its closed position, the user need only apply the force sufficient to overcome the counterbalancing force of spring 52. This construction provides smooth and easy operation of door assembly 22 as it is moved between its open and closed positions.

It can also be appreciated that, when door assembly 22 is in its closed position, lower door subassembly 26 functions to apply a biasing force tending to urge door assembly 22 toward its open position. The majority of the weight of the components of lower door subassembly 26 is spaced forwardly of pivot pin 68 when door assembly 22 is closed, which applies a clockwise moment at pivot pin 68 tending to urge link 27 upwardly. This upward force on link 27 combines with the force applied by spring 52 to provide an upward bias on upper door subassembly 24, which assists in counterbalancing upper door subassembly 24 by applying a counterclockwise biasing moment at pivot pin 48.

The operating components of door assembly 22 located adjacent end walls 18, 20 are typically located within a space defined between each end wall and an interior cover panel which prevents articles from coming into contact with the components of door assembly 22.

Figure 11:
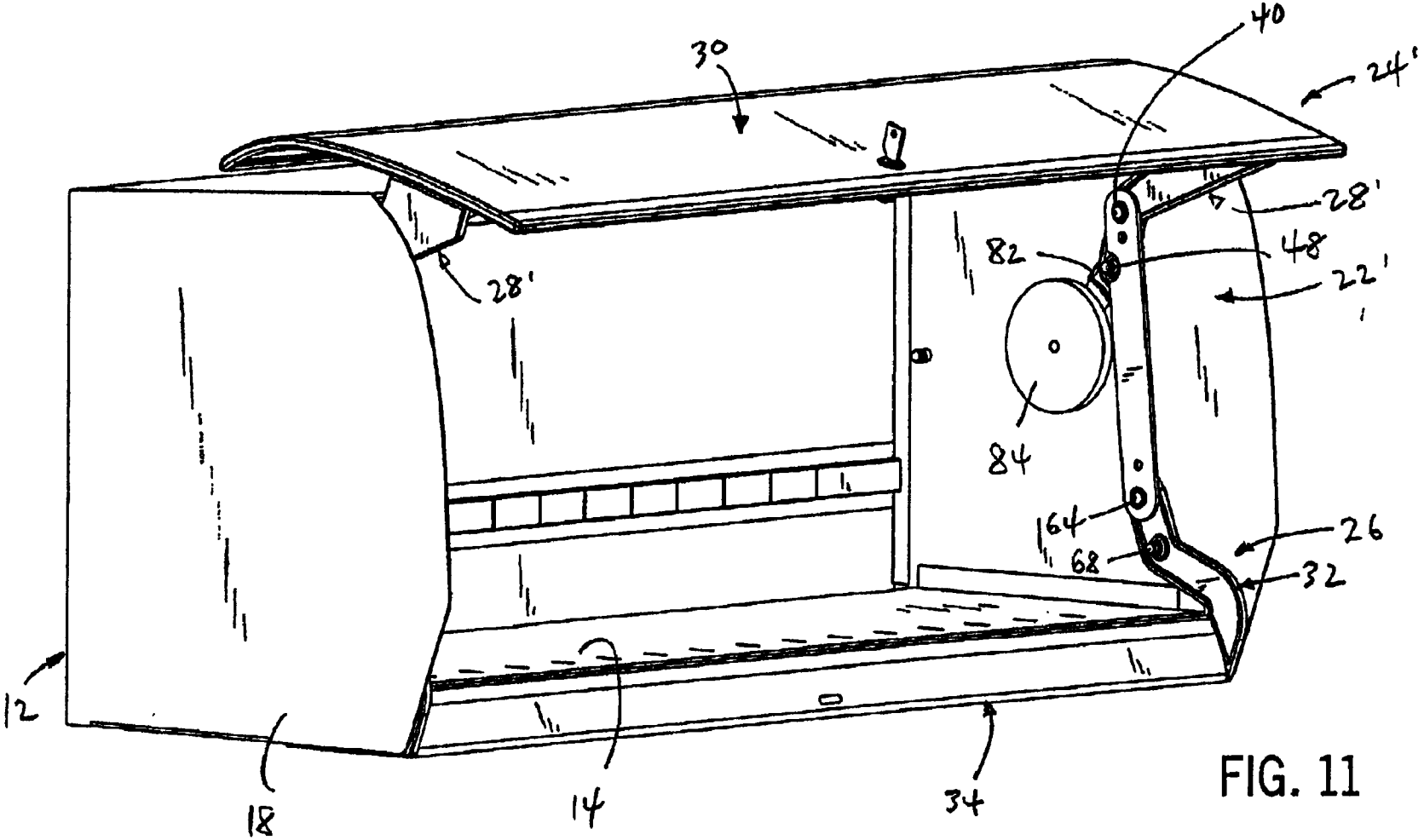
FIG. 11 is a view similar to FIG. 1, showing an alternative embodiment for the biasing arrangement incorporated into the counterbalanced door system of the present invention.

FIG. 11 illustrates an alternative storage unit 10', which contains many of the same components as storage unit 10, as indicated by like reference characters. In this version, upper arms 28' each define an inner end 82 extending rearwardly of pivot pin 48. A counterweight 84 is secured to each inner end 82, for providing a counterclockwise bias on upper arms 28' tending to move upper door member 30 toward its open position. Counterweights 84 function in the same manner as springs 52 to assist door assembly 22' of storage unit 10' to move to its open position and to retain the components of door assembly 22' in the open position. The weight of counterweight 74 is selected so that, when door assembly 22' is in its closed position in which upper door member 30 and lower door member 34 are moved together, the moment exerted by upper door subassembly 24' is sufficient to maintain door assembly 22' closed.

While the invention has been shown and described with respect to particular embodiments, it is understood that variations and alternatives are contemplated as being within the scope of the present invention. For example, and without limitation, the biasing force of either spring 52 or counterweight 84 has been shown as being applied to upper arms 28. It is also understood that the biasing force may be applied to lower arms 32 or to link 27. In addition, while a linear spring has been shown and described as one way to apply the biasing force, it is also contemplated that a torsion spring may be employed to provide a biasing force tending to rotate either upper door subassembly 24 or lower door subassembly 26 toward its closed position. While a single link has been illustrated as being connected between upper arm 28 and lower arm 32, it is also contemplated that a linkage consisting of multiple links may be interposed between the upper and lower arms, or that a gear arrangement may be employed to synchronize movement of upper door subassembly 24 and lower door subassembly 26. A spring or counterweight may be provided at either end of door assembly 22 or at only one of its ends, to provide the biasing force, if desired.

In addition, the counterbalancing feature of the present invention may be provided in a cabinet assembly having a single door member, and need not be employed in a clamshell-type door having two door members as shown and described. In a version such as this, link 27 and lower door subassembly 26 are omitted and upper door 30 is constructed so as to fully enclose the open front of case 12 when in its closed position.

Further, while upper arms 28 and lower arms 32 are shown as being pivotably mounted to cabinet assembly 12 at spaced apart locations, it is also contemplated that upper arms 28 and lower arms 32 may be pivotably mounted to cabinet assembly 12 for movement about a common pivot axis. While the door assembly has been shown and described with respect to pivotable mounting of the arms to the end walls of the cabinet assembly, it is also contemplated that the arms may be mounted to any other part of the cabinet assembly for pivotable movement between their open and closed positions, e.g. the back wall, top wall or bottom wall of the cabinet.

Various other alternatives and embodiments are contemplated as being within the scope of the following claims particularly pointing out and distinctly claiming the subject matter regarded as the invention.

We claim:

1. A storage unit, comprising:

a cabinet defining an interior;

a door assembly comprising a first door section and a second door section, each of which is pivotably mounted to the cabinet for movement between an open position and a closed position, wherein the first door section comprises a first door member and a first arm secured to the first door member in a fixed angular relationship and wherein the second door section comprises a second door member and a second arm secured to the second door member in a fixed angular relationship, wherein the first and second arms are pivotably interconnected with the cabinet to provide movement of the first and second door sections, respectively, between the open and closed positions, and wherein the first and second door sections prevent access to the interior of the cabinet when in the closed position and provide access to the interior of the cabinet when in the open position;

a link pivotably interconnected between the first and second arms so as to synchronize movement of the first and second door sections between the open and closed positions; and a biasing arrangement interconnected with at least one of the door sections for counterbalancing the door assembly;

wherein the biasing arrangement and the first and second door sections are constructed and arranged so that the biasing arrangement applies a biasing force to the first and second door sections that biases the first and second door sections toward the open position, wherein the biasing force applied by the biasing arrangement is operable to maintain the first and second door sections in the open position when the first and second door sections are moved to the open position, and is further operable to enable the first and second door sections to remain in the closed position when the first and second door sections are moved to the closed position, and is further operable to maintain the position of the first and second door sections in position when the first and second door sections are moved to a position between the open and closed positions.

2. The storage unit of claim 1, wherein the first and second arm members are pivotably mounted to the cabinet at spaced locations.

3. The storage unit of claim 1, wherein the biasing arrangement comprises a spring interconnected with one of the first and second arm members, wherein the spring is operable to exert a biasing force on the arm member at a location offset from a pivot axis defined by the pivotable mounting of the arm member to the cabinet.

4. The storage unit of claim 1, wherein the biasing arrangement comprises a weight mounted to one of the first and second arm members at a location offset from a pivot axis defined by the pivotable mounting of the arm member to the cabinet.

5. A storage unit, comprising:

a cabinet defining an open front;

a first door section pivotably mounted to the cabinet, wherein the first door section comprises a first door member and a first arm secured to the first door member in a fixed angular relationship, wherein the first arm is pivotably mounted to the cabinet for pivotably mounting the first door section to the cabinet for movement relative to the cabinet between an open position and a closed position;

a second door section pivotably mounted to the cabinet, wherein the second door section comprises a second door member and a second arm secured to the second door member in a fixed angular relationship, wherein the second arm is pivotably mounted to the cabinet for pivotably mounting the second door section to the cabinet for movement relative to the cabinet between an open position and a closed position;

wherein the first and second door sections are together when in the closed positions to close the open front of the cabinet, and are apart when in the open positions to provide access to the open front of the cabinet;

a link member pivotably interconnected between the first arm and the second arm, wherein the link member is constructed and arranged so as to move one of the door sections in response to movement of the other; and a biasing arrangement interconnected with one of the door sections for counterbalancing the weight of at least one of the door sections.

6. The storage unit of claim 5, wherein the biasing arrangement and the first and second door sections are constructed and arranged so that the force of the biasing arrangement applies a biasing force to the first and second door sections that biases the first and second door sections toward the open position, wherein the biasing force applied by the biasing arrangement is operable to maintain the first and second door sections in the open position when the first and second door sections are moved to the open position, and is further operable to enable the first and second door sections to remain in the closed position when the first and second door sections are moved to the closed position, and is further operable to maintain the position of the first and second door sections when the first and second door sections are moved to a position between the open and closed positions.

7. The storage unit of claim 6, wherein the link member is pivotably engaged with one of the first and second arms at a location between the open front of the cabinet and a pivot axis defined by the pivotable mounting of the arm to the cabinet, and is pivotably engaged with the other of the first and second arms at a location rearwardly of a pivot axis defined by the pivotable mounting of the other arm to the cabinet.

8. The storage unit of claim 6, wherein the biasing arrangement comprises a spring interconnected between the cabinet and one of the first and second arms, wherein the spring is operable to apply a biasing force to the arm.

9. The storage unit of claim 6, wherein the biasing arrangement comprises a counterweight mounted to one of the first and second arms at a location rearwardly of a pivot axis defined by the pivotable mounting of the arm to the cabinet.

10. In a storage unit including a cabinet defining an open front and an upper door member, the improvement comprising an upper arm secured to the upper door member, in a fixed angular relationship and a pivot connection interposed between the upper arm and the cabinet for providing movement of the upper arm, and thereby the upper door member, about an upper pivot axis, and a lower door member and a lower arm secured together in a fixed angular relationship, wherein the lower arm is interconnected with the cabinet via a pivot connection for providing movement of the lower arm, and thereby the lower door member, about a lower pivot axis, wherein the upper and lower door members are movable between an open position providing access to the open front of the cabinet and a closed position for closing the open front of the cabinet, and a spring interconnected between the cabinet and one of the arms, and further comprising a link member interconnected between the upper arm and the lower arm, wherein the link member is operable to synchronize movement of the upper and lower door members between the open and closed positions, wherein the spring and the arm are constructed and arranged such that the spring applies a biasing force to the arm which counterbalances the weight of the door members, wherein the biasing force urges the door members toward the open position, and wherein the spring, the arms and the door members are constructed and arranged so that the biasing force applied by the spring is operable to maintain the door members in the open position when the door members is are moved to the open position, and is further operable to enable the door members to remain in the closed position when the door members are moved to the closed position, and is further operable to maintain the door members in position when the door members are moved to a position between the open and closed positions.

11. The storage unit of claim 10, wherein the link member is pivotably interconnected with the upper arm at a location forwardly of the upper pivot axis, and wherein the link member is pivotably interconnected with the lower arm at a location rearwardly of the lower pivot axis.

12. The storage unit of claim 10, wherein the spring comprises a linear spring having forward and rearward ends, wherein the rearward end of the spring is fixed to the cabinet and wherein the forward end of the spring is mounted to a spring mounting arrangement associated with the arm.

13. The storage unit of claim 12, wherein the spring mounting arrangement associated with the arm comprises a spring mounting section that extends upwardly from the arm at a location above the pivot axis.

14. The storage unit of claim 13, wherein the rearward end of the spring is interconnected with the cabinet at a location below the engagement of the forward end of the spring with the spring mounting section of the arm.

* * * * *

UNITED STATES PATENT AND TRADEMARK OFFICE

CERTIFICATE OF CORRECTION

PATENT NO. : 6,779,856 B2
DATED : August 24, 2004
INVENTOR(S) : Timothy G. Hornberger et al.

It is certified that error appears in the above-identified patent and that said Letters Patent is hereby corrected as shown below:

Title page,
Item [57], ABSTRACT,
Line 8, delete “oven” and substitute therefore -- open --.

Column 9,
Line 41, after “member” delete “,”;

Column 10,
Line 20, delete “is”.

Signed and Sealed this

Twenty-ninth Day of March, 2005

JON W. DUDAS
*Director of the United States Patent and Trademark Office*